US011794474B2

(12) United States Patent
Mikoshiba et al.

(10) Patent No.: US 11,794,474 B2
(45) Date of Patent: Oct. 24, 2023

(54) LIQUID EJECTING HEAD AND LIQUID EJECTING APPARATUS

(71) Applicant: SEIKO EPSON CORPORATION, Tokyo (JP)

(72) Inventors: Masanori Mikoshiba, Shimosuwa-Machi (JP); Motoki Takabe, Shiojiri (JP); Jingling Wang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 17 days.

(21) Appl. No.: 17/645,120

(22) Filed: Dec. 20, 2021

(65) Prior Publication Data

US 2022/0194081 A1 Jun. 23, 2022

(30) Foreign Application Priority Data

Dec. 22, 2020 (JP) ..... 2020-212190

(51) Int. Cl.
*B41J 2/14* (2006.01)

(52) U.S. Cl.
CPC ..... *B41J 2/14233* (2013.01)

(58) Field of Classification Search
None
See application file for complete search history.

(56) References Cited

U.S. PATENT DOCUMENTS

2016/0067967 A1 3/2016 Naganuma et al.
2016/0096368 A1* 4/2016 Yazaki ..... B41J 2/1632 347/70

FOREIGN PATENT DOCUMENTS

JP 2016-058467 A 4/2016

* cited by examiner

*Primary Examiner* — Erica S Lin
(74) *Attorney, Agent, or Firm* — WORKMAN NYDEGGER

(57) ABSTRACT

A liquid ejecting head includes: an actuator including a piezoelectric element and a vibrating plate; and a pressure chamber substrate including a pressure chamber whose volume changes when the vibrating plate deforms, in which $0.35 \times FR1 \leq FR2 < 1.00 \times FR1$, where one position in a longitudinal direction of the pressure chamber is a first position, another position closer than the first position to an end of the pressure chamber in the longitudinal direction of the pressure chamber is a second position, bending rigidity of the actuator in the thickness direction at the first position is FR1, and bending rigidity of the actuator in the thickness direction at the second position is FR2.

11 Claims, 8 Drawing Sheets

LIQUID EJECTING HEAD AND LIQUID EJECTING APPARATUS

The present application is based on, and claims priority from JP Application Serial Number 2020-212190, filed Dec. 22, 2020, the disclosure of which is hereby incorporated by reference herein in its entirety.

BACKGROUND

1. Technical Field

The present disclosure relates to a liquid ejecting head and a liquid ejecting apparatus.

2. Related Art

JP-A-2016-58467 discloses a liquid ejecting head that includes an actuator constituted by a vibrating plate and a piezoelectric element, a plurality of pressure chambers, and nozzles for communicating with the pressure chambers. The liquid ejecting head is provided in a liquid ejecting apparatus such as a printer and changes the volume of the pressure chambers by driving the actuator to thereby eject, from the nozzles, liquid such as ink supplied to the pressure chambers.

For example, in the liquid ejecting head of JP-A-2016-58467, when a thickness of the actuator in a longitudinal direction of a pressure chamber is the same at a position close to the center of the pressure chamber and a position close to an end of the pressure chamber, there is a problem that the actuator is hardly displaced due to rigidity of the actuator at the position close to the end of the pressure chamber. On the other hand, in an instance in which the thickness of the actuator at the position close to the end of the pressure chamber is small, the displacement of the actuator may become small at the position close to the center of the pressure chamber when the actuator is driven.

SUMMARY

A liquid ejecting head includes: an actuator that includes a piezoelectric element which includes a first electrode, a second electrode, and a piezoelectric body and in which the piezoelectric body is provided between the first electrode and the second electrode in a thickness direction in which the first electrode, the second electrode, and the piezoelectric body are stacked, and a vibrating plate which is provided on one side in the thickness direction with respect to the piezoelectric element; and a pressure chamber substrate that is provided on the one side in the thickness direction with respect to the vibrating plate and that includes a pressure chamber whose volume changes when the vibrating plate deforms, in which $0.35 \times FR1 \leq FR2 < 1.00 \times FR1$, where, in a longitudinal direction of the pressure chamber, which intersects the thickness direction, and a transverse direction of the pressure chamber, which intersects the thickness direction and the longitudinal direction, one position in the longitudinal direction of the pressure chamber is a first position, another position closer to an end of the pressure chamber than the first position in the longitudinal direction of the pressure chamber is a second position, bending rigidity of the actuator in the thickness direction at the first position is FR1, and bending rigidity of the actuator in the thickness direction at the second position is FR2.

A liquid ejecting apparatus includes: the liquid ejecting head; and a control section that controls an ejection operation of the liquid ejecting head.

DESCRIPTION OF EXEMPLARY EMBODIMENTS

1. Embodiment 1

Figure 1:
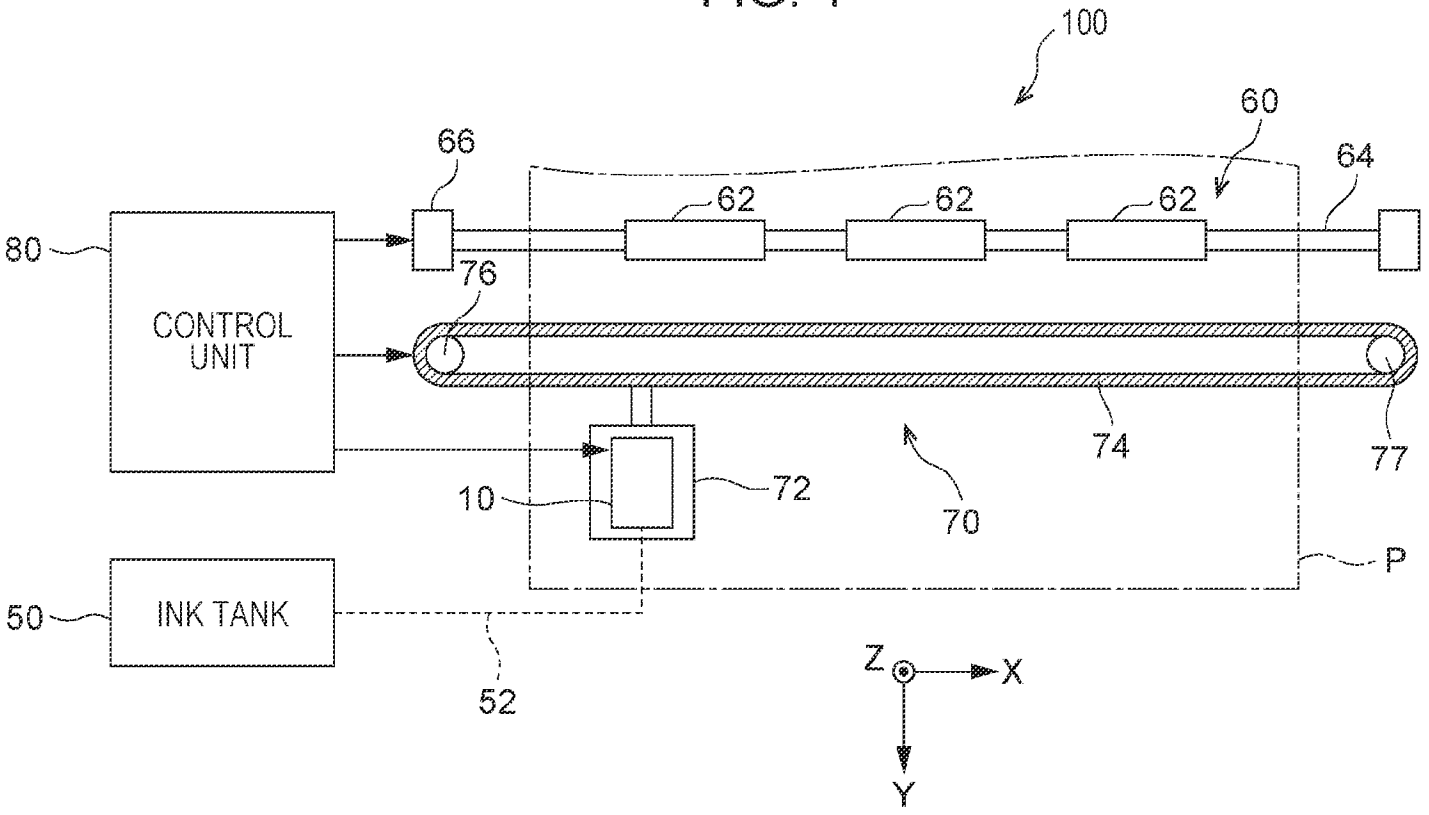
FIG. 1 is a block diagram illustrating a schematic configuration of a liquid ejecting apparatus including a liquid ejecting head, which is an embodiment of the disclosure.

FIG. 1 is a block diagram illustrating a schematic configuration of a liquid ejecting apparatus 100 including a liquid ejecting head 10, which is an embodiment of the disclosure. In the present embodiment, the liquid ejecting apparatus 100 is configured as an ink jet printer and forms an image by ejecting ink, which is an example of a liquid, onto printing paper P. Note that, instead of the printing paper P, any type of media made from resin film, fabric, or the like may be an ink ejection target. FIG. 1 represents three axes that are orthogonal to each other, that is, the X-axis, the Y-axis, and the Z-axis. The Z-axis may be set parallel to the vertical direction, for example. The X-axis, the Y-axis, and the Z-axis described in other drawings all correspond respectively to the X-axis, the Y-axis, and the Z-axis in FIG. 1. When a direction is specified, a positive direction is denoted by "+", a negative direction is denoted by "−", and positive and negative symbols are used together to indicate directions. The positive direction and the negative direction are also called axis directions. Note that the Z-axis direction corresponds to a subordinate concept of a thickness direction, the X-axis direction corresponds to a subordinate concept of a longitudinal direction of a pressure chamber 341 described later, and the Y-axis direction corresponds to a subordinate concept of a transverse direction of the pressure chamber 341. Moreover, the −Z direction corresponds to a subordinate concept of one side in the thickness direction, and the +Z direction corresponds to a subordinate concept of the other side in the thickness direction. The −X direction corresponds to a subordinate concept of one end side in the longitudinal direction of the pressure chamber 341, and the +X direction corresponds to a subordinate concept of the other end side in the longitudinal direction of the pressure chamber 341. Note that the X-axis, the Y-axis, and the Z-axis are not limited to being orthogonal to each other and may intersect each other at any angle.

The liquid ejecting apparatus 100 includes the liquid ejecting head 10, an ink tank 50, a transport mechanism 60, a moving mechanism 70, and a control unit 80.

The liquid ejecting head 10 includes a plurality of nozzles and ejects the ink in the −Z direction to form an image on the printing paper P. A detailed configuration of the liquid ejecting head 10 will be described later. As the ejected ink, for example, ink of four colors in total, that is, black, cyan, magenta, and yellow, may be ejected. Note that, in addition to the four colors described above, ink of any color, such as light cyan, light magenta, and white, may be ejected. The liquid ejecting head 10 is mounted on a carriage 72, which will be described later, included in the moving mechanism 70 and reciprocates in main scanning directions together with movement of the carriage 72. In the present embodiment, the main scanning directions correspond to the +X direction and the −X direction.

The ink tank 50 stores ink to be ejected from the liquid ejecting head 10. The ink tank 50 is not mounted on the carriage 72. The ink tank 50 and the liquid ejecting head 10 are coupled by a resin tube 52, and the ink is supplied from the ink tank 50 to the liquid ejecting head 10 via the tube 52. Note that, instead of the ink tank 50, a bag-like liquid pack formed from a flexible film may be used.

The transport mechanism 60 transports the printing paper P in a sub-scanning direction. The sub-scanning direction is a direction orthogonal to the X-axis direction, which is the main scanning direction, and corresponds to the +Y direction or the −Y direction in the present embodiment. The transport mechanism 60 includes a transport rod 64 to which three transport rollers 62 are attached and a transport motor 66 that rotationally drives the transport rod 64. When the transport motor 66 rotationally drives the transport rod 64, the plurality of transport rollers 62 rotate, and the printing paper P is transported in the +Y direction, which is the sub-scanning direction. Note that the number of transport rollers 62 is not limited to three and may be any number. In addition, the configuration may be such that a plurality of transport mechanisms 60 are included.

The moving mechanism 70 includes a transport belt 74, a movement motor 76, and a pulley 77 in addition to the carriage 72 described above. The liquid ejecting head 10 is mounted on the carriage 72 in a state in which the liquid ejecting head 10 is able to eject the ink. The carriage 72 is attached to the transport belt 74. The transport belt 74 is stretched between the movement motor 76 and the pulley 77. When the movement motor 76 is rotationally driven, the transport belt 74 circulates in the main scanning directions. As a result, the carriage 72 attached to the transport belt 74 also reciprocates in the main scanning directions.

The control unit 80 controls the entire liquid ejecting apparatus 100. The control unit 80 is an example of a control section. For example, the control unit 80 controls an operation of reciprocating the carriage 72 in the main scanning directions, an operation of transporting the printing paper P in the sub-scanning direction, and an ejection operation of the liquid ejecting head 10. In the present embodiment, the control unit 80 also functions as a drive control section of an actuator 20 described later. That is, the control unit 80 controls the ejection of ink onto the printing paper P by outputting a drive signal to the liquid ejecting head 10 to drive the actuator 20. The control unit 80 may include, for example, one or more processing circuits, such as a central processing unit (CPU) or a field programmable gate array (FPGA), and one or more storage circuits, such as semiconductor memory.

Figure 2:
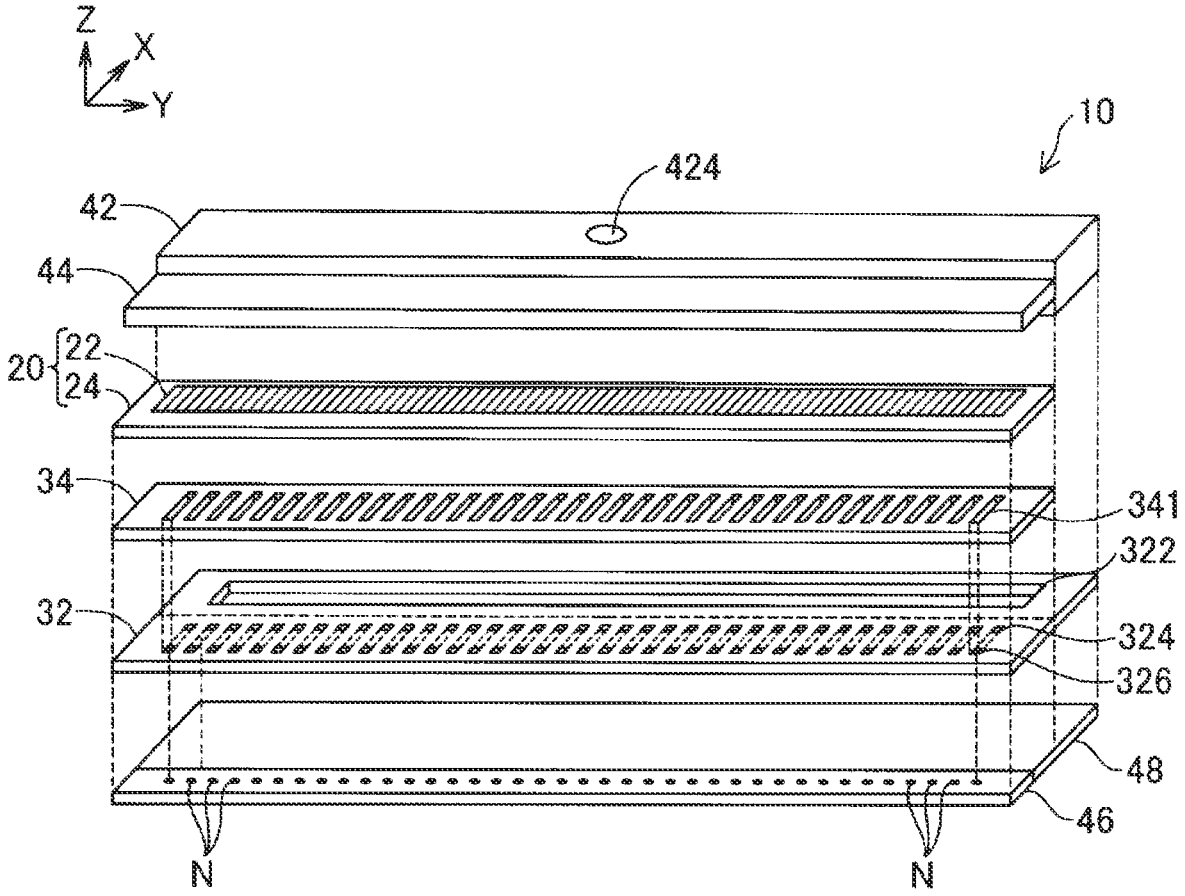
FIG. 2 is an exploded perspective view illustrating a detailed configuration of the liquid ejecting head.

FIG. 2 exemplifies the configuration of the liquid ejecting head 10 for a single color. Accordingly, the configuration may be such that a plurality of liquid ejecting heads 10 illustrated in FIG. 2 are included in accordance with the number of colors of the ink to be ejected. In addition, the configuration may be such that a plurality of liquid ejecting heads 10 illustrated in FIG. 2 are included for each color. As illustrated in FIG. 2, the liquid ejecting head 10 includes a nozzle plate 46, a vibration absorber 48, a channel substrate 32, a pressure chamber substrate 34, a housing 42, a sealing body 44, and the actuator 20.

The nozzle plate 46 is a thin plate member in which a plurality of nozzles N are formed in a line side by side in the Y-axis direction. Note that the number of rows of nozzles N is not limited to one and may be any number. Each of the nozzles N is formed as a through hole in the Z-axis direction in the nozzle plate 46. The nozzle N corresponds to an ejection opening of the ink from the liquid ejecting head 10. The nozzle plate 46 is located at the lowermost position in the −Z direction in the liquid ejecting head 10. In the present embodiment, the nozzle plate 46 is formed of a silicon (Si) single crystal substrate. Note that the nozzle plate 46 is not limited to being formed of a silicon (Si) single crystal substrate and may be formed of other types of metals, such as stainless steel (SUS) and nickel (Ni) alloy, resin materials, such as polyimide and dry film resist, inorganic materials, such as a single crystal substrate made of a material other than silicon, and the like. Although FIG. 2 indicates an aspect in which the nozzle plate 46 extends so as not to overlap a wiring substrate 90 in the X-axis direction, the nozzle plate 46 may extend in the −X direction up to a position at which the nozzle plate 46 overlaps the wiring substrate 90 in the X-axis direction.

Figure 3:
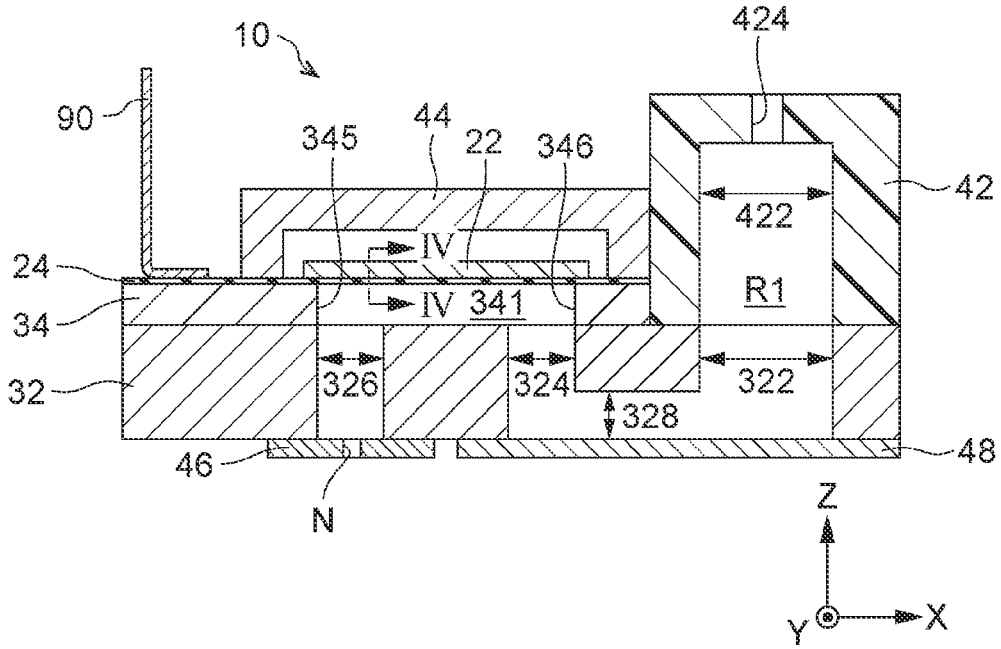
FIG. 3 is a sectional view illustrating a detailed configuration of the liquid ejecting head.

The vibration absorber 48 is a flexible sheet member that is elastically deformable. The vibration absorber 48 is, similarly to the nozzle plate 46, located at the lowermost position in the −Z direction in the liquid ejecting head 10 and is disposed side by side with the nozzle plate 46. As illustrated in FIG. 3, the vibration absorber 48 absorbs pressure deformation of a liquid reserve chamber R1 formed in the housing 42 and a portion of the channel substrate 32. The vibration absorber 48 closes an opening section 322, which will be described later, formed in the channel substrate 32, a relay channel 328, and a plurality of supply channels 324 to form a bottom surface of the liquid reserve chamber R1. The vibration absorber 48 may be constituted by, for example, a resin sheet member. The vibration absorber 48 is also called a compliance substrate.

The channel substrate 32 is a plate member for forming an ink channel. As illustrated in FIG. 3, the surface of the channel substrate 32 in the −Z direction is bonded to the nozzle plate 46 and the vibration absorber 48. Such bonding may be realized by using an adhesive, for example. In the present embodiment, the channel substrate 32 is formed of a silicon (Si) single crystal substrate. Note that the channel substrate 32 is not limited to being formed of a silicon single crystal substrate and may be formed of a substrate containing silicon as a main component. As illustrated in FIGS. 2 and 3, the channel substrate 32 is formed with the opening section 322, the supply channel 324, and a communication channel 326. The channel substrate 32 is also called a communication plate.

As illustrated in FIG. 2, when viewed in the Z-axis direction, the opening section 322 is formed as a through hole having a substantially rectangular shape in plan view with the X-axis direction as the transverse direction and the Y-axis direction as the longitudinal direction. The opening section 322 is formed as a single through hole so as to include all positions corresponding to the supply channels 324, which correspond to the respective nozzles N, in the X-axis direction. As illustrated in FIG. 3, the opening section 322 forms the liquid reserve chamber R1 together with an accommodating section 422, which will be described later, of the housing 42. The liquid reserve chamber R1 temporarily reserves the ink supplied from the ink tank 50 via the tube 52. The liquid reserve chamber R1 is also called a reservoir.

As illustrated in FIG. 2, the supply channels 324 are formed at positions corresponding to the respective nozzles N in the +X direction. Accordingly, the supply channels 324 are disposed in a line side by side in the Y-axis direction similarly to the nozzles N. Each of the supply channels 324 is formed as a through hole that passes through the channel substrate 32 in the thickness direction. As illustrated in FIG. 3, a groove is formed between the opening section 322 and the supply channels 324 on the surface of the channel substrate 32 in the −Z direction, more specifically, on the surface of the channel substrate 32 on the vibration absorber 48 side. A region demarcated by the groove and the vibration absorber 48 functions as the relay channel 328. The opening section 322, which forms the liquid reserve chamber R1, and the supply channels 324 communicate with each other through the relay channel 328. The relay channel 328 relays the ink from the liquid reserve chamber R1 to the supply channels 324. Each of the supply channels 324 communicates with an end portion of a corresponding one of pressure chambers 341 in the +X direction and supplies the ink to the pressure chamber 341. In other words, the pressure chamber 341 communicates with the supply channel 324 in the end portion of the pressure chamber 341 in the +X direction.

As illustrated in FIG. 2, communication channels 326 are formed at positions corresponding to the respective nozzles N in the +Z direction and positions corresponding to the respective supply channels 324 in the −X direction. Accordingly, the communication channels 326 are disposed in a line side by side in the Y-axis direction similarly to the nozzles N and the supply channels 324. As illustrated in FIG. 3, the communication channel 326 communicates with the nozzle N and an end portion of the pressure chamber 341 in the −X direction and supplies the ink of the pressure chamber 341 to the nozzle N. In other words, the pressure chamber 341 communicates with the nozzle N in the end portion of the pressure chamber 341 in the −X direction.

The pressure chamber substrate 34 is a plate member for forming the pressure chamber 341. In other words, the pressure chamber 341 is provided in the pressure chamber substrate 34. As illustrated in FIG. 3, the −Z direction surface of the pressure chamber substrate 34 is bonded to the +Z direction surface of the channel substrate 32. Such bonding may be realized by using an adhesive. In the present embodiment, the pressure chamber substrate 34 is formed of a silicon single crystal substrate similarly to the channel substrate 32. Note that the pressure chamber substrate 34 is not limited to being formed of a silicon single crystal substrate and may be formed of a substrate containing silicon as a main component. As illustrated in FIGS. 2 and 3, the pressure chamber substrate 34 is formed with a plurality of pressure chambers 341.

When viewed in the Z-axis direction, each of the pressure chambers 341 is formed as a through hole having a substantially rectangular shape in plan view with the X-axis direction as the longitudinal direction and the Y-axis direction as the transverse direction. The pressure chambers 341 are formed at positions corresponding to the respective nozzles N in the +Z direction. Accordingly, the plurality of pressure chambers 341 are formed linearly side by side in the Y-axis direction similarly to the nozzles N. Note that the surface of the pressure chamber 341 in the −Z direction is defined by a vibrating plate 24, which will be described later, bonded to the pressure chamber substrate 34. Side walls of the pressure chamber 341 in the X-axis direction function as partition walls 345 and 346 that partition the pressure chamber 341. The pressure chamber 341 communicates with the supply channel 324 and the communication channel 326 and accommodates the ink supplied from the supply channel 324. The volume of the pressure chamber 341 changes when the vibrating plate 24 described later deforms. When viewed in the Z-axis direction, each of the pressure chambers 341 has a substantially rectangular shape in plan view with the X-axis direction as the longitudinal direction and the Y-axis direction as the transverse direction.

The housing 42 has a hollow substantially square column appearance shape that is open on one side. In the present embodiment, the housing 42 is made of resin. As illustrated in FIG. 3, the housing 42 is bonded to the +Z direction surface of the channel substrate 32. The accommodating section 422 is formed in the housing 42. The accommodating section 422 is open in the −Z direction and communicates with the opening section 322 at the opening to form the liquid reserve chamber R1. As illustrated in FIGS. 2 and 3, an inlet 424 is formed in a ceiling portion, which corresponds to an end portion of the housing 42 in the +Z direction. The inlet 424 passes through the end portion of the housing 42 in the +Z direction and communicates with the liquid reserve chamber R1. The tube 52 illustrated in FIG. 1 is coupled to the inlet 424. Note that an ink reserve section (not illustrated), such as a temporary storage tank, may be coupled to the inlet 424 via a tube (not illustrated). In this configuration, the ink may be supplied from the ink tank 50 to the ink reserve section via the tube 52.

The sealing body 44 has a hollow substantially square column appearance shape that is open on one side. In the present embodiment, the sealing body 44 is formed of a silicon single crystal substrate. As illustrated in FIG. 3, the sealing body 44 is disposed such that a piezoelectric element 22 described later is accommodated in the sealing body 44, and the sealing body 44 is bonded to the +Z direction surface of the vibrating plate 24 described later. The sealing body 44 protects the piezoelectric element 22 and reinforces the mechanical strength of a portion of the pressure chamber substrate 34 and the vibrating plate 24.

As illustrated in FIG. 3, in the liquid ejecting head 10, the wiring substrate 90 is coupled to the +Z direction surface of the vibrating plate 24. A plurality of wires that are coupled to the control unit 80 and to a power supply circuit (not illustrated) are formed in the wiring substrate 90. In the present embodiment, the wiring substrate 90 is constituted by, for example, an FPC (flexible printed circuit). Note that the wiring substrate 90 may be constituted by any substrate having flexibility, such as an FFC (flexible flat cable), instead of the FPC. The wiring substrate 90 supplies a drive signal for driving actuators 20 to each of the actuators 20.

The actuator 20 deforms to thereby change the volume of the pressure chamber 341 and causes the ink to flow out from the pressure chamber 341.

Figure 4:
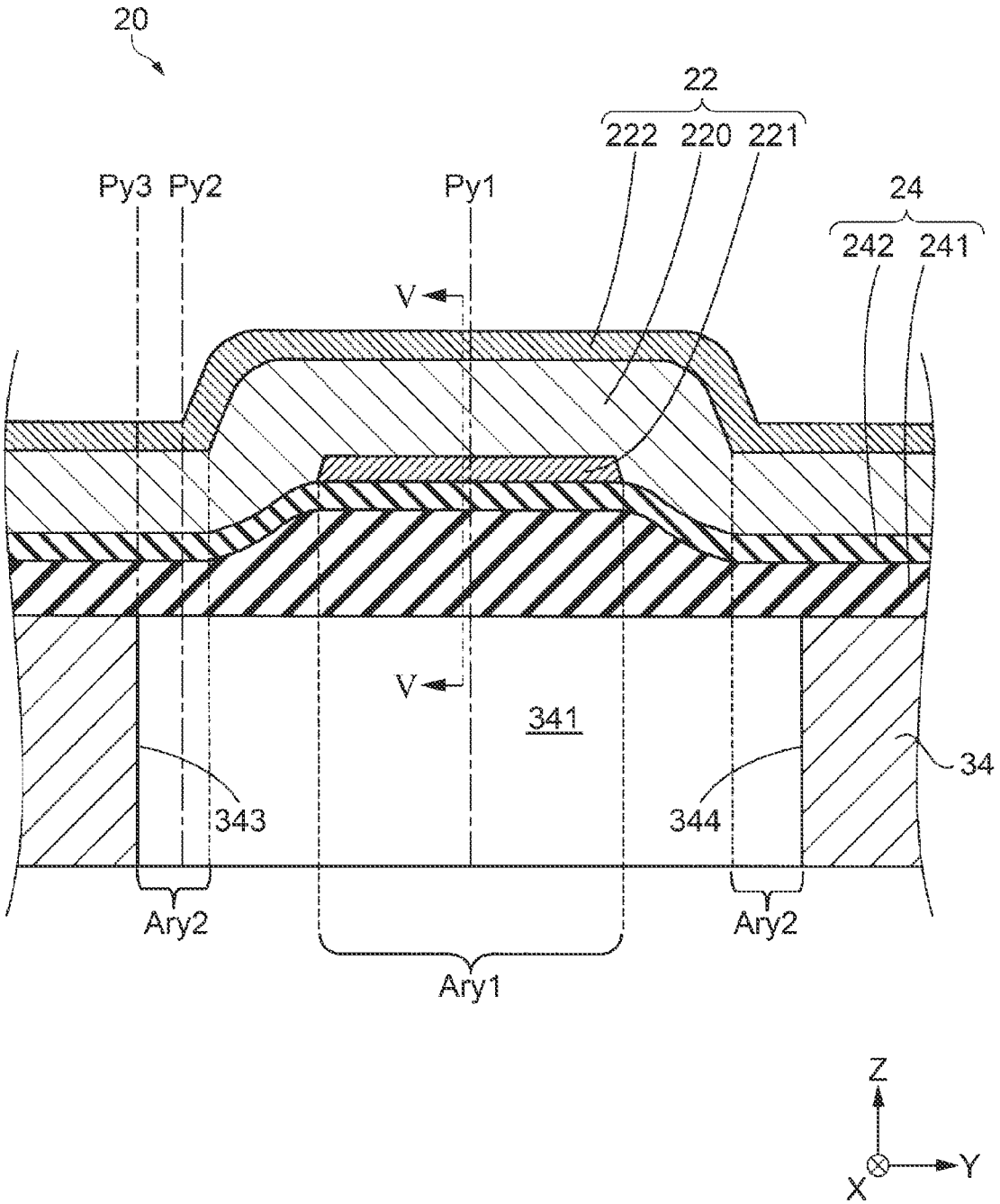
FIG. 4 is a sectional view of an actuator illustrated in FIG. 3, which is taken along line IV-IV.
Figure 5:
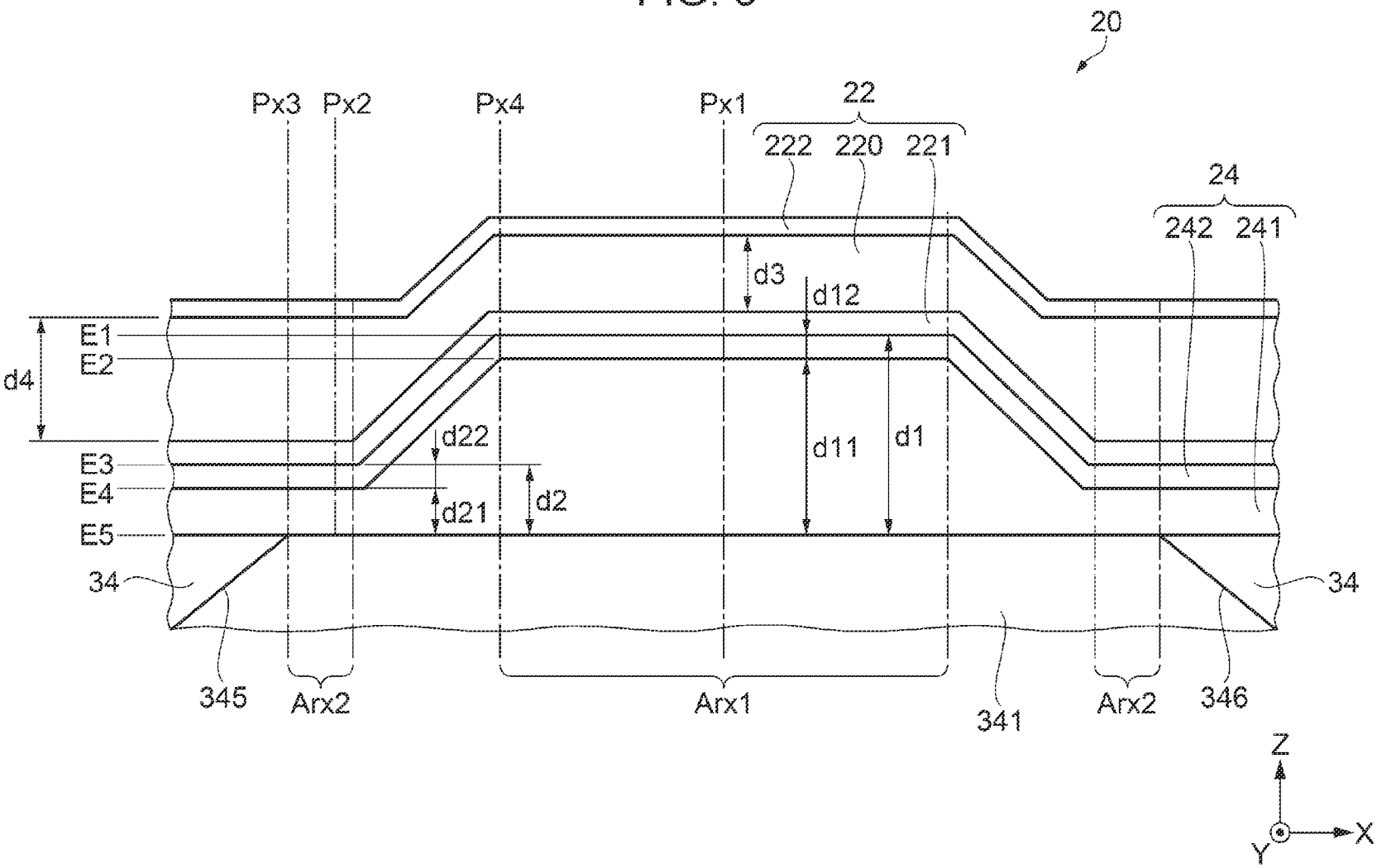
FIG. 5 is a sectional view of the actuator illustrated in FIG. 4, which is taken along line V-V.

FIGS. 4 and 5 are sectional views illustrating a detailed configuration of the actuator 20 and also illustrate the pressure chamber substrate 34 of the liquid ejecting head 10 for convenience of description. The actuator 20 includes the vibrating plate 24 and a plurality of piezoelectric elements 22.

The vibrating plate 24 is provided on the +Z direction side in the Z-axis direction with respect to the pressure chamber substrate 34. The vibrating plate 24 includes an elastic body layer 241 and an insulation layer 242. The vibrating plate 24 has a structure in which the elastic body layer 241 and the insulation layer 242 are stacked in the Z-axis direction. The elastic body layer 241 is disposed on the surface of the pressure chamber substrate 34 in the +Z direction. The insulation layer 242 is disposed on the surface of the elastic body layer 241 in the +Z direction. The elastic body layer 241 is made of silicon dioxide ($SiO_2$). The insulation layer 242 is made of zirconium oxide ($ZrO_2$).

The piezoelectric element 22 includes a piezoelectric body 220, a first electrode 221, and a second electrode 222. Similarly to the vibrating plate 24, the piezoelectric element 22 has a structure in which layers of the piezoelectric body 220, the first electrode 221, and the second electrode 222 are stacked in the Z-axis direction. In other words, the piezoelectric element 22 includes the first electrode 221, the second electrode 222, and the piezoelectric body 220.

The piezoelectric body 220 is a film member formed of a material having a piezoelectric effect and deforms in response to a voltage applied to the first electrode 221 and the second electrode 222. The piezoelectric body 220 is disposed so as to cover a portion of the surface of the insulation layer 242 of the vibrating plate 24 in the +Z direction and the surface of the first electrode 221 in the +Z direction. The piezoelectric body 220 is tapered such that the surface in the +Z direction protrudes slightly in the +Z direction in a portion in the vicinity of the center in the X-axis direction and such that a dimension in the X-axis direction increases from the +Z direction side toward the −Z direction side.

In the present embodiment, the piezoelectric body 220 is made of lead zirconate titanate (PZT). Note that the piezoelectric body 220 may be made of another kind of ceramic having an ABO3-type perovskite structure, such as barium titanate, lead titanate, potassium niobate, lithium niobate, lithium tantalate, sodium tungstate, zinc oxide, barium strontium titanate (BST), strontium bismuth tantalate (SBT), lead metaniobate, lead zinc niobate, lead scandium niobate, or the like, instead of lead zirconate titanate. In addition, the piezoelectric body 220 is not limited to being formed of a ceramic and may be formed of any material having a piezoelectric effect, such as polyvinylidene fluoride or quartz.

The first electrode 221 and the second electrode 222 correspond to a pair of electrodes holding the piezoelectric body 220 therebetween. In other words, the piezoelectric body 220 is provided between the first electrode 221 and the second electrode 222 in the Z-axis direction. The first electrode 221 is located on the vibrating plate 24 side with respect to the piezoelectric body 220 and is provided on the surface of the insulation layer 242 of the vibrating plate 24 in the +Z direction. In other words, the first electrode 221 is provided on the −Z direction side in the Z-axis direction with respect to the piezoelectric body 220. The first electrode 221 is disposed so as to cover the center of the pressure chamber 341 in the Y-axis direction. The first electrode 221 is tapered such that a dimension in the Y-axis direction increases from the +Z direction side toward the −Z direction side. The second electrode 222 is located on the opposite side of the piezoelectric body 220 from the vibrating plate 24 side and is provided on the surface of the piezoelectric body 220 in the +Z direction. The second electrode 222 covers an outer shape of the piezoelectric body 220.

The first electrode 221 and the second electrode 222 are both electrically coupled to the wiring substrate 90, and a voltage corresponding to a drive signal supplied from the wiring substrate 90 is applied to the piezoelectric body 220. Different drive voltages are supplied to the first electrode 221 in accordance with an ejection amount of ink, and a constant holding voltage is supplied to the second electrode 222 regardless of the ejection amount of ink. As a result, a potential difference is generated between the first electrode 221 and the second electrode 222, and the piezoelectric body 220 deforms. That is, when the piezoelectric element 22 is driven, the vibrating plate 24 deforms or vibrates, and when the volume of the pressure chamber 341 changes, pressure is applied to the ink stored in the pressure chamber 341, and the ink is ejected from the nozzle N via the communication channel 326.

In the present embodiment, the first electrode 221 is coupled to an individual wire extending from the wiring substrate 90 to each of the actuators 20. The first electrode 221 is a so-called individual electrode individually provided for the respective actuators 20. On the other hand, the second electrode 222 is a common electrode common to the respective actuators 20 and is coupled to a single common wire extending from the wiring substrate 90. For example, a contact hole may be provided in advance in the insulation layer 242 which is formed on an outer surface of the first electrode 221 such that the individual wire described above is in contact with the first electrode 221 via the contact hole. In addition, the common electrode described above may be formed, for example, slightly larger than the piezoelectric body 220 when the second electrode 222 is viewed in the −Z direction, an insulation layer may be formed in a portion of the second electrode 222, in which the piezoelectric body 220 is not present in the +Z direction, a contact hole may be provided in advance in the insulation layer, and the common electrode may be in contact with the second electrode 222 of each of the actuators 20 via the contact hole.

In the present embodiment, the first electrode 221 and the second electrode 222 are made of platinum (Pt). Note that the first electrode 221 and the second electrode 222 may be formed of any conductive material, such as gold (Au) or iridium (Ir), instead of platinum. Alternatively, the first electrode 221 and the second electrode 222 may be formed such that a plurality of materials, such as platinum (Pt), gold (Au), and iridium (Ir), are stacked. For example, the first electrode 221 may be made of platinum (Pt) and iridium (Ir), and the second electrode 222 may be made of iridium (Ir).

As illustrated in FIG. 4, the vibrating plate 24, the first electrode 221, the piezoelectric body 220, and the second electrode 222 are disposed in order from the −Z direction side toward the +Z direction side in region Ary1 in a central portion in the pressure chamber 341 in the Y-axis direction. Moreover, the vibrating plate 24, the piezoelectric body 220, and the second electrode 222 are disposed in order from the −Z direction side toward the +Z direction side in each of two regions Ary2 at end portions including ends in the pressure chamber 341 in the Y-axis direction. That is, both the vibrating plate 24 and the piezoelectric body 220 are provided in region Ary1 and regions Ary2.

In the present embodiment, region Ary1 is a region corresponding to an active portion in which application of a voltage to the first electrode 221 and the second electrode 222 causes deflection and is, for example, a region in a central portion including the center of the pressure chamber 341 in the Y-axis direction. The dimension of region Ary1 in the Y-axis direction is substantially the same as the dimension of the first electrode 221 in the Y-axis direction.

Regions Ary2 are located outside region Ary1 in the Y-axis direction, that is, in the −Y direction with respect to region Ary1 and in the +Y direction with respect to region Ary1. Regions Ary2 are regions closer than region Ary1 to partition walls 343 and 344 of the pressure chamber 341. Regions Ary2 are also regions corresponding to a non-active portion. Regions Ary2 are, for example, regions at two end portions closer than region Ary1 to ends of the pressure chamber 341 in the Y-axis direction.

As illustrated in FIG. 4, region Ary1 includes position Py1 at the center in the pressure chamber 341 in the Y-axis direction. Region Ary2 includes position Py3 overlapping the +Z direction end portion of the partition wall 343 in the Y-axis direction and includes position Py2 located closer than position Py1 in region Ary1 to the partition wall 343. Regarding two positions in the pressure chamber 341, position Py1 and position Py2, the distance from the partition wall 343 to position Py1 in the +Y direction is greater than the distance from the partition wall 343 to position Py2 in the +Y direction. The end of the pressure chamber 341 on the −Y direction side in the Y-axis direction is defined by the end portion of the partition wall 343 in the +Z direction. In other words, position Py2 is located closer to the end of the pressure chamber 341 in the Y-axis direction than position Py1. In the following description, region Ary1 is also called a third region Ary1, region Ary2 is also called a fourth region Ary2, position Py1 is also called a third position Py1, and position Py2 is also called a fourth position Py2.

As illustrated in FIG. 4, the vibrating plate 24 has a convex shape in which the +Z direction surface in the third region Ary1 protrudes slightly in the +Z direction from the +Z direction surface in the fourth region Ary2. On the other hand, the vibrating plate 24 is formed such that the −Z direction surface in the third region Ary1 and the −Z direction surface in the fourth region Ary2 are at the same positions in the +Z direction. Accordingly, in the vibrating plate 24, the thickness in the third region Ary1 differs from the thickness in the fourth region Ary2. Similarly, the piezoelectric body 220 also has a convex shape in which the +Z direction surface in the third region Ary1 protrudes slightly in the +Z direction from the +Z direction surface in the fourth region Ary2, and the thickness in the third region Ary1 differs from the thickness in the fourth region Ary2.

When the thickness of the vibrating plate 24 or the piezoelectric body 220 differs between the third region Ary1 and the fourth region Ary2 as in the present embodiment, the position of a neutral axis of the actuator 20 is able to be made to differ between the third region Ary1 and the fourth region Ary2. The neutral axis of the actuator 20 corresponds to a shaft-like portion intersecting a neutral surface on any sectional surface of the actuator 20 along the Z-axis. The neutral surface of the actuator 20 is a surface on which neither compressive strain nor tensile strain is caused when a bending moment is applied to the actuator 20. For example, when the active portion of the piezoelectric element 22 deforms by contracting, compressive strain is caused in a portion located in the +Z direction with respect to the neutral axis of the actuator 20, and tensile strain is caused in a portion located in the −Z direction with respect to the neutral axis on the sectional surface illustrated in FIG. 4.

In the actuator 20 of the present embodiment, the thickness of the vibrating plate 24 in the third region Ary1 is larger than the thickness of the vibrating plate 24 in the fourth region Ary2. In addition, the thickness of the piezoelectric body 220 in the third region Ary1 is larger than the thickness of the piezoelectric body 220 in the fourth region Ary2. Accordingly, in the actuator 20 of the present embodiment, the neutral axis in the third region Ary1 is able to be located in the +Z direction with respect to the neutral axis in the fourth region Ary2 at each position in the Y-axis direction. Thus, a ratio of a portion of the piezoelectric element 22, which is located in the +Z direction with respect to the neutral axis, in the third region Ary1 is larger than that in the fourth region Ary2. As a result, in the third region Ary1, the piezoelectric element 22 deforms to thereby enable the vibrating plate 24 to deform efficiently.

On the other hand, a ratio of a portion of the piezoelectric element 22, which is located in the −Z direction with respect to the neutral axis, in the fourth region Ary2 is larger than that in the third region Ary1. Accordingly, since the piezoelectric element 22 in the fourth region Ary2 is suppressed from deforming, the vibrating plate 24 is suppressed from deforming excessively. Since the fourth region Ary2 is closer than the third region Ary1 to an end of the pressure chamber 341 in the Y-axis direction, a portion of the actuator 20, which is included in the fourth region Ary2, has a tendency to be damaged due to excessive deformation of the vibrating plate 24. Accordingly, when the thickness of the vibrating plate 24 in the fourth region Ary2 is smaller than the thickness of the vibrating plate 24 in the third region Ary1, the actuator 20 is effectively suppressed from being damaged.

FIG. 5 is a sectional view illustrating a detailed configuration of the actuator 20. For convenience of description, hatching is omitted in FIG. 5. FIG. 5 illustrates a sectional surface of the center of the pressure chamber 341, which passes through the third region Ary1, in the Y-axis direction. Accordingly, the vibrating plate 24, the first electrode 221, the piezoelectric body 220, and the second electrode 222 are disposed in order from the −Z direction side toward the +Z direction side in region Arx1, which corresponds to a central portion in the pressure chamber 341 in the X-axis direction, similarly to the third region Ary1. Moreover, the vibrating plate 24, the first electrode 221, the piezoelectric body 220, and the second electrode 222 are disposed in order from the −Z direction side toward the +Z direction side in each of two regions Arx2 at end portions in the pressure chamber 341 in the X-axis direction. That is, both the vibrating plate 24 and the piezoelectric body 220 are provided in region Arx1 and regions Arx2.

In the present embodiment, region Arx1 is, for example, a region in a central portion including the center of the pressure chamber 341 in the X-axis direction. In addition, regions Arx2 are located outside region Arx1 in the X-axis direction, that is, in the −X direction with respect to region Arx1 and in the +X direction with respect to region Arx1, and are each closer than region Arx1 to a corresponding one of the partition walls 345 and 346 of the pressure chamber 341. Regions Arx2 are, for example, regions at two end portions closer than region Arx1 to the ends of the pressure chamber 341 in the X-axis direction. As illustrated in FIG. 5, region Arx1 includes position Px1 at the center of the pressure chamber 341 in the X-axis direction. Position Px1 is an example of a position close to the center of the pressure chamber 341 in the X-axis direction. Region Arx2 includes, in the X-axis direction, position Px3 overlapping the end portion of the partition wall 345 in the +Z direction and includes position Px2 located closer to the partition wall 345 than position Px1 in region Arx1. Regarding two positions in the pressure chamber 341, position Px1 and position Px2, the distance from the partition wall 345 to position Px1 in the +X direction is greater than the distance from the partition wall 345 to position Px2 in the +X direction. The end of the pressure chamber 341 on the −X direction side in the X-axis direction is defined by the end portion of the partition wall 345 in the +Z direction. In other words, position Px2 is located closer to the end of the pressure chamber 341 in the X-axis direction than position Px1. In the following description, region Arx1 is also called a first region Arx1, region Arx2 is also called a second region Arx2, position Px1 is also called a first position Px1, and position Px2 is also called a second position Px2.

As illustrated in FIG. 5, the vibrating plate 24 has a convex shape in which the +Z direction surface in the first region Arx1 protrudes slightly in the +Z direction from the +Z direction surface in the second region Arx2. On the other hand, the vibrating plate 24 is formed such that the −Z direction surface in the first region Arx1 and the −Z direction surface in the second region Arx2 are at the same positions in the +Z direction. The convex shape of the vibrating plate 24 in the first region Arx1 is tapered such that a dimension in the X-axis direction increases from the +Z direction side toward the −Z direction side. Accordingly, in the vibrating plate 24, the thickness in the first region Arx1 differs from the thickness in the second region Arx2. Similarly, the piezoelectric body 220 also has a convex shape in which the +Z direction surface in the first region Arx1 protrudes slightly in the +Z direction from the +Z direction surface in the second region Arx2. In addition, the convex shape of the piezoelectric body 220 in the first region Arx1 is tapered such that a dimension in the X-axis direction increases from the +Z direction side toward the −Z direction side. Accordingly, in the piezoelectric body 220, the thickness in the first region Arx1 differs from the thickness in the second region Arx2. Moreover, a sum of the thickness of the vibrating plate 24 in the first region Arx1 and the thickness of the piezoelectric body 220 in the first region Arx1 differs from a sum of the thickness of the vibrating plate 24 in the second region Arx2 and the thickness of the piezoelectric body 220 in the second region Arx2.

When the thickness of the vibrating plate 24 differs between the first region Arx1 and the second region Arx2 as in the present embodiment, bending rigidity of the actuator 20 is able to be made to differ between the first region Arx1 and the second region Arx2. In addition, when the thickness of the piezoelectric body 220 differs between the first region Arx1 and the second region Arx2, the bending rigidity of the actuator 20 is able to be made to differ between the first region Arx1 and the second region Arx2. When a sum of the thickness of the vibrating plate 24 and the thickness of the piezoelectric body 220 differs between the first region Arx1 and the second region Arx2, the bending rigidity of the actuator 20 is able to be made to differ between the first region Arx1 and the second region Arx2. The bending rigidity reflects a resistance to a change in bending of a member when force is applied to the member. When a member receives only a bending moment, the bending rigidity is represented by a product of a Young's modulus E of the member and a geometrical moment of inertia I, which is determined by the sectional shape and size of the member. Accordingly, a member having a large product EI is hardly bent.

As illustrated in FIG. 5, thickness d2 of the vibrating plate 24 at the second position Px2 is smaller than thickness d1 of the vibrating plate 24 at the first position Px1. Specifically, thickness d21 of the elastic body layer 241 at the second position Px2 is smaller than thickness d11 of the elastic body layer 241 at the first position Px1. In addition, thickness d22 of the insulation layer 242 at the second position Px2 is equal to thickness d12 of the insulation layer 242 at the first position Px1. Note that, at the first position Px1, thickness d11 of the elastic body layer 241 is, for example, 1000 nanometers, and thickness d12 of the insulation layer 242 is, for example, 200 nanometers. At the second position Px2, thickness d21 of the elastic body layer 241 is, for example, 500 nanometers, and thickness d22 of the insulation layer 242 is, for example, 200 nanometers.

In the second region Arx2, the thickness of the vibrating plate 24 at position Px3 is the same as thickness d2 of the vibrating plate 24 at the second position Px2. Specifically, the thickness of the elastic body layer 241 at position Px3 is the same as thickness d21 of the elastic body layer 241 at the second position Px2. In addition, the thickness of the insulation layer 242 at position Px3 is the same as thickness d22 of the insulation layer 242 at the second position Px2. Accordingly, the thickness of the vibrating plate 24 at position Px3 is smaller than thickness d1 of the vibrating plate 24 at the first position Px1 similarly to the second position Px2.

As illustrated in FIG. 5, the surface of the vibrating plate 24 in the −Z direction, that is, the surface of the elastic body layer 241 in the −Z direction, extends in the X-axis direction. Accordingly, as illustrated in FIG. 5, at the first position Px1, the second position Px2, and position Px3, an end portion E5 of the vibrating plate 24 in the −Z direction is disposed at the same position in the Z-axis direction.

On the other hand, the surface of the vibrating plate 24 in the +Z direction, that is, the surface of the insulation layer 242 in the +Z direction, in the first region Arx1 is located in the +Z direction further than the surface of the insulation layer 242 in the +Z direction in the second region Arx2. Specifically, an end portion E1 of the insulation layer 242 at the first position Px1 in the +Z direction is disposed closer to the piezoelectric body 220 than an end portion E3 of the insulation layer 242 at the second position Px2 in the +Z direction. In other words, the end portion E3 of the insulation layer 242 at the second position Px2 in the +Z direction is disposed in the −Z direction from the end portion E1 of the insulation layer 242 at the first position Px1 in the +Z direction.

Similarly, the surface of the elastic body layer 241 in the +Z direction in the first region Arx1 is also located in the +Z direction further than the surface of the elastic body layer 241 in the +Z direction in the second region Arx2. Specifically, an end portion E2 of the elastic body layer 241 at the first position Px1 in the +Z direction is disposed closer to the piezoelectric body 220 than an end portion E4 of the elastic body layer 241 at the second position Px2 in the +Z direction. In other words, the end portion E4 of the elastic body layer 241 at the second position Px2 in the +Z direction is disposed in the −Z direction from the end portion E2 of the elastic body layer 241 at the first position Px1 in the +Z direction.

Thus, in the present embodiment, it can be said that, in the +Z direction from the end portion E5 of the vibrating plate 24 in the −Z direction, the end portion E1 in the first region Arx1 in the +Z direction is disposed in the +Z direction further than the end portion E3 in the second regions Arx2 in the +Z direction such that the thickness of the vibrating plate 24 in the second region Arx2 is set to be smaller than the thickness of the vibrating plate 24 in the first region Arx1.

As illustrated in FIG. 5, in the present embodiment, thickness d4 of the piezoelectric body 220 at the second position Px2 is larger than thickness d3 of the piezoelectric body 220 at the first position Px1. In addition, thickness d4 of the piezoelectric body 220 at the second position Px2 is larger than thickness d2 of the vibrating plate 24 at the second position Px2. Thickness d3 of the piezoelectric body 220 at the first position Px1 is smaller than thickness d1 of the vibrating plate 24 at the first position Px1. Note that the thickness of the piezoelectric body 220 at position Px3 is the same as thickness d4 of the piezoelectric body 220 at the second position Px2. Note that thickness d3 of the piezoelectric body 220 at the first position Px1 is, for example, 1200 nanometers, and thickness d4 of the piezoelectric body 220 at the second position Px2 and position Px3 is, for example, 1250 nanometers.

Accordingly, a sum of thickness d2 of the vibrating plate 24 and thickness d4 of the piezoelectric body 220 in the second region Arx2 including the second position Px2 and position Px3 is smaller than a sum of thickness d1 of the vibrating plate 24 and thickness d3 of the piezoelectric body 220 in the first region Arx1 including the first position Px1. In addition, a sum of thickness d2 of the vibrating plate 24 at the second position Px2 and thickness d4 of the piezoelectric body 220 at the second position Px2 is larger than thickness d1 of the vibrating plate 24 at the first position Px1 and larger than thickness d3 of the piezoelectric body 220 at the first position Px1. A difference between thickness d2 of the vibrating plate 24 and thickness d4 of the piezoelectric body 220 at the second position Px2 is larger than a difference between thickness d1 of the vibrating plate 24 at the first position Px1 and thickness d3 of the piezoelectric body 220 at the first position Px1.

As described above, in the actuator 20 of the present embodiment, the neutral axis in the first region Arx1 is able to be located in the +Z direction with respect to the neutral axis in the second region Arx2 at each position in the X-axis direction. Thus, a ratio of a portion of the piezoelectric element 22, which is located in the +Z direction with respect to the neutral axis, in the first region Arx1 including the first position Px1 is larger than that in the second region Arx2 including the second position Px2 and position Px3. As a result, the piezoelectric element 22 deforms in the first region Arx1 to thereby enable the vibrating plate 24 to deform efficiently.

On the other hand, a ratio of a portion of the piezoelectric element 22, which is located in the −Z direction with respect to the neutral axis, in the second region Arx2 is larger than that in the first region Arx1. Accordingly, since the piezoelectric element 22 is suppressed from deforming in the second region Arx2, the vibrating plate 24 is suppressed from deforming excessively. Since the second region Arx2 is closer to the end of the pressure chamber 341 in the X-axis direction than the first region Arx1, a portion of the actuator 20, which is included in the second region Arx2, has a tendency to be damaged due to excessive deformation of the vibrating plate 24. Accordingly, when thickness d2 of the vibrating plate 24 in the second region Arx2 is smaller than thickness d1 of the vibrating plate 24 in the first region Arx1, the actuator 20 is effectively suppressed from being damaged. Note that the neutral axis of the actuator 20 in the first region Arx1 is more desirably located in the vibrating plate 24, and the neutral axis of the actuator 20 in the second region Arx2 is more desirably located in the piezoelectric body 220.

In the actuator 20 having a configuration as in the present embodiment, the bending rigidity of the actuator 20 in the second region Arx2 including the second position Px2 and position Px3 is able to be set to be lower than the bending rigidity of the actuator 20 in the first region Arx1 including the first position Px1. When the bending rigidity in the second region Arx2 is lower than the bending rigidity in the first region Arx1, the actuator 20 is able to readily deform compared with an instance in which the bending rigidity in the second region Arx2 and the bending rigidity in the first region Arx1 are the same. On the other hand, when the bending rigidity in the second region Arx2 is excessively lower than the bending rigidity in the first region Arx1, due to being pulled by a strong deflection force in the second region Arx2, which is applied when the actuator 20 is driven, displacement of the actuator 20 at the central position of the pressure chamber 341 in the X-axis direction, for example, at the first position Px1, may be smaller than displacement of the actuator 20 at a position of an end portion of the pressure chamber 341 in the X-axis direction, for example, in an end portion of the pressure chamber 341 at the second position Px2. That is, it is desirable that the bending rigidity in the second region Arx2 be lower than the bending rigidity in the first region Arx1, but it is not desirable that the bending rigidity in the second region Arx2 be excessively lower than the bending rigidity in the first region Arx1.

Figure 6:
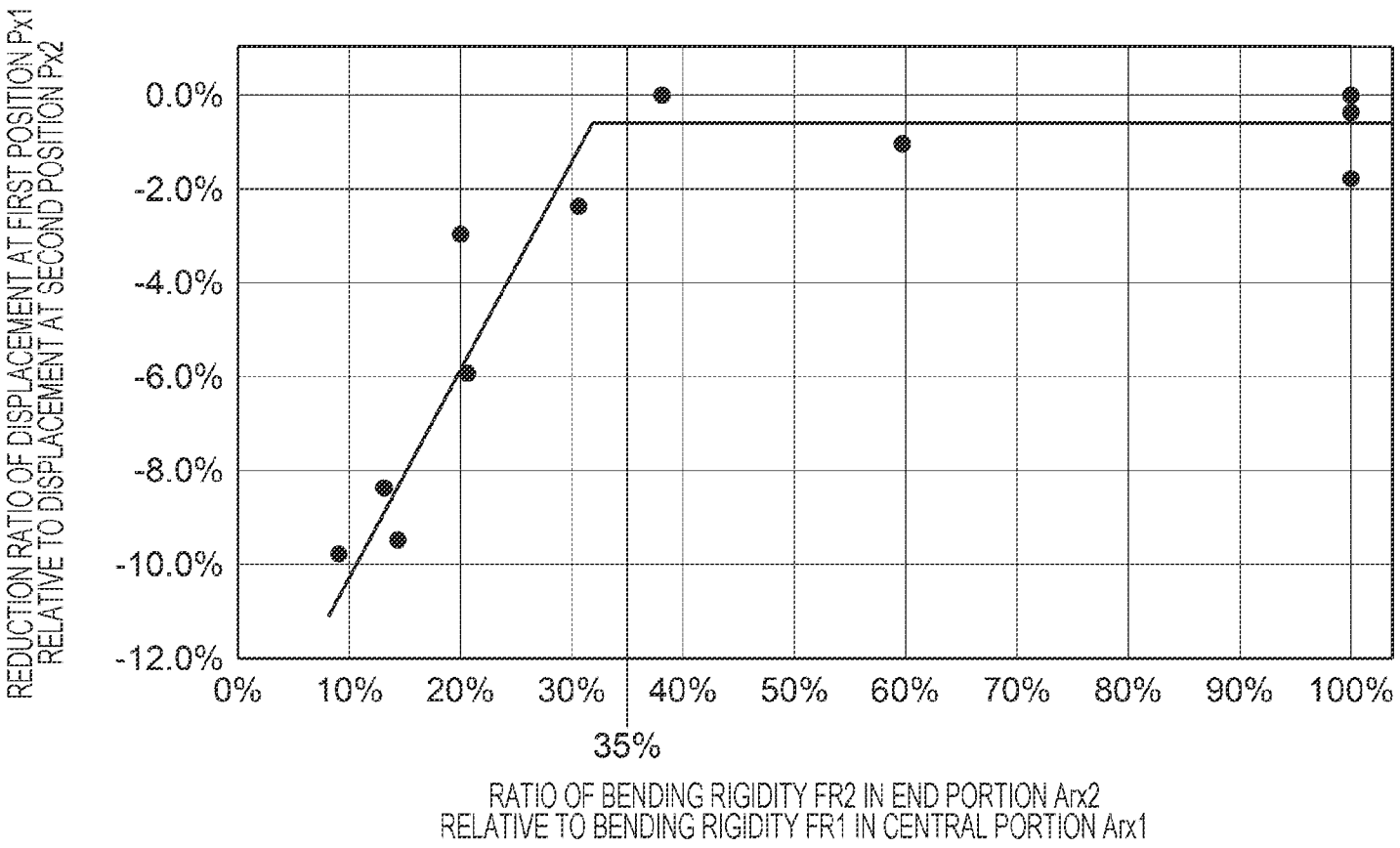
FIG. 6 is a graph indicating a relationship between a ratio of bending rigidity in an end portion of a pressure chamber relative to bending rigidity in a central portion of the pressure chamber and displacement of the actuator in the center of the pressure chamber.

In view of the above, study is conducted to determine to which degree the bending rigidity in the second region Arx2 is made lower than the bending rigidity in the first region Arx1 when displacement of the actuator 20 at the central position of the pressure chamber 341 in the X-axis direction is significantly reduced. Specifically, liquid ejecting heads that differ from each other in a ratio of d11 and d21 in FIG. 5, that is, the bending rigidity in the first region Arx1 and the second region Arx2, are manufactured, and displacement of each of the actuators 20 at the central position of the pressure chamber 341 in the X-axis direction when the actuator 20 is driven is measured. FIG. 6 illustrates evaluation of a reduction ratio of displacement of the actuator 20 at the first position Px1 relative to displacement of the actuator 20 at the second position Px2 when the actuator 20 is driven in each of the plurality of liquid ejecting heads described above. The bending rigidity here indicates bending rigidity of the actuator 20 in the Z-axis direction. The bending rigidity in the first region Arx1 corresponds to the bending rigidity at the first position Px1 included in the first region Arx1, and the bending rigidity in the second region Arx2 corresponds to the bending rigidity at the second position Px2 included in the second region Arx2.

As shown from FIG. 6, the reduction ratio of displacement of the actuator 20 at the first position Px1 relative to displacement of the actuator 20 at the second position Px2 significantly changes when a ratio of the bending rigidity in the second region Arx2 relative to the bending rigidity in the first region Arx1 is smaller than 35 percent, and the reduction ratio increases when the ratio of the bending rigidity in the second region Arx2 relative to the bending rigidity in the first region Arx1 is reduced. In addition, when the ratio of the bending rigidity in the second regions Arx2 relative to the bending rigidity in the first region Arx1 is more than or equal to 35 percent, the reduction ratio of displacement of the actuator 20 at the first position Px1 relative to displacement of the actuator 20 at the second position Px2 changes to such an extent that the change cannot be confirmed.

Thus, in the actuator 20 having a configuration as in the present embodiment, when the bending rigidity of the actuator 20 in the Z-axis direction is FR, the bending rigidity in the first region Arx1 including the first position Px1 is FR1, and the bending rigidity of the actuator 20 in the second region Arx2 including the second position Px2 is FR2, the bending rigidity FR2 is set to be more than or equal to 35 percent of the bending rigidity FR1 and smaller than the bending rigidity FR1. For example, in the present embodiment, when thickness d11 of the elastic body layer 241 at the first position Px1 is 1000 nanometers, thickness d12 of the insulation layer 242 at the first position Px1 is 200 nanometers, thickness d3 of the piezoelectric body 220 at the first position Px1 is 1200 nanometers, thickness d21 of the elastic body layer 241 at the second position Px2 is 500 nanometers, thickness d22 of the insulation layer 242 at the second position Px2 is 200 nanometers, and thickness d4 of the piezoelectric body 220 at the second position Px2 is 1250 nanometers, the bending rigidity FR2 is 59.2 percent of the bending rigidity FR1. Note that when the bending rigidity FR2 is more than or equal to 85 percent of the bending rigidity FR1, displacement of the actuator 20 has a variation in some cases. Thus, when the variation in displacement of the actuator 20 described above is considered, the bending rigidity FR2 may be set to be more than or equal to 35 percent of the bending rigidity FR1 and less than 85 percent of the bending rigidity FR1.

As described above, the liquid ejecting head 10 according to Embodiment 1 is able to exert the following effects.

The liquid ejecting head 10 includes: the actuator 20 that includes the piezoelectric element 22 which includes the first electrode 221, the second electrode 222, and the piezoelectric body 220 and in which the piezoelectric body 220 is provided between the first electrode 221 and the second electrode 222 in the Z-axis direction in which the first electrode 221, the second electrode 222, and the piezoelectric body 220 are stacked, and the vibrating plate 24 which is provided on the −Z direction side in the Z-axis direction with respect to the piezoelectric element 22; and the pressure chamber substrate 34 that is provided on the −Z direction side in the Z-axis direction with respect to the vibrating plate 24 and that includes the pressure chamber 341 whose volume changes when the vibrating plate 24 deforms, in which $0.35 \times FR1 \leq FR2 < 1.00 \times FR1$, where, in the X-axis direction of the pressure chamber 341, which intersects the Z-axis direction, and the Y-axis direction of the pressure chamber 341, which intersects the Z-axis direction and the X-axis direction, one position in the X-axis direction of the pressure chamber 341 is the first position Px1, another position closer than the first position Px1 to an end of the pressure chamber 341 in the X-axis direction of the pressure chamber 341 is the second position Px2, bending rigidity of the actuator 20 in the Z-axis direction is FR, the bending rigidity of the actuator 20 at the first position Px1 is FR1, and the bending rigidity of the actuator 20 at the second position Px2 is FR2. Accordingly, the actuator 20 is able to be readily displaced while suppressing a reduction in displacement of the actuator 20 at the position close to the center of the pressure chamber 341 in the X-axis direction when the actuator 20 is driven.

In the liquid ejecting head 10, $FR2 < 0.85 \times FR1$. This also enables the actuator 20 to be readily displaced.

In the liquid ejecting head 10, thickness d2 of the vibrating plate 24 at the second position Px2 is smaller than thickness d1 of the vibrating plate 24 at the first position Px1. Accordingly, a reduction in thickness d2 of the vibrating plate 24 at the second position Px2 enables the neutral axis to be relatively on the piezoelectric element 22 side, and it is possible to suppress cracking of the actuator 20.

In the liquid ejecting head 10, thickness d4 of the piezoelectric body 220 at the second position Px2 is larger than thickness d3 of the piezoelectric body 220 at the first position Px1. Accordingly, an increase in thickness d4 of the piezoelectric body 220 at the second position Px2 enables the neutral axis to be relatively on the piezoelectric element 22 side, and it is possible to suppress cracking of the actuator 20.

In the liquid ejecting head 10, a sum of thickness d2 of the vibrating plate 24 at the second position Px2 and thickness d4 of the piezoelectric body 220 at the second position Px2 is smaller than a sum of thickness d1 of the vibrating plate 24 at the first position Px1 and thickness d3 of the piezoelectric body 220 at the first position Px1. Accordingly, when the thickness of the actuator 20 at the second position Px2 is smaller than the thickness of the actuator 20 at the first position Px1, the bending rigidity of the actuator 20 at the second position Px2 is able to be set to be lower than the bending rigidity of the actuator 20 at the first position Px1, and the actuator 20 is able to be readily displaced.

In the liquid ejecting head 10, when a region including the center in the X-axis direction of the pressure chamber 341 is the first region Arx1, and a region including the end in the X-axis direction of the pressure chamber 341 is the second region Arx2, the first position Px1 is included in the first region Arx1, and the second position Px2 is included in the second region Arx2. Accordingly, the bending rigidity of the actuator 20 in the second region Arx2 is able to be set to be lower than the bending rigidity of the actuator 20 in the first region Arx1, and the actuator 20 is able to be readily displaced while suppressing a reduction in displacement of the actuator 20 in the first region Arx1 when the piezoelectric element 22 is driven.

In the liquid ejecting head 10, a plurality of pressure chambers 341 are disposed in the Y-axis direction, the first electrode 221 is provided individually for the plurality of pressure chambers 341, the second electrode 222 is provided in common for the plurality of pressure chambers 341, the first electrode 221 is provided on the −Z direction side in the Z-axis direction with respect to the piezoelectric body 220, and the second electrode 222 is provided on the +Z direction side in the Z-axis direction with respect to the piezoelectric body 220. Accordingly, by separately controlling drive of the first electrode 221 and drive of the second electrode 222, it is possible to easily achieve a configuration in which the plurality of pressure chambers 341 are separately controlled and a configuration in which the plurality of pressure chambers 341 are collectively controlled.

In the liquid ejecting head 10, the pressure chamber 341 is provided such that the −X direction side in the X-axis direction of the pressure chamber 341 communicates with the nozzle N for ejecting ink and that the +X direction side in the X-axis direction of the pressure chamber 341 communicates with the supply channel 324 for supplying the ink to the pressure chamber 341. Accordingly, it is possible to easily achieve a configuration in which driving the piezoelectric element 22 enables the ink supplied to the pressure chamber 341 to be ejected from the nozzle N.

The liquid ejecting apparatus 100 includes the liquid ejecting head 10 and the control unit 80 that controls an ejection operation of the liquid ejecting head 10. Accordingly, it is possible to easily achieve a configuration in which the ejection operation of the liquid ejecting head 10 is able to be controlled.

2. Embodiment 2

Next, an actuator 20*a* included in the liquid ejecting head 10 in Embodiment 2, which is an embodiment of the disclosure, will be described. Note that the same parts as those of the actuator 20 included in the liquid ejecting head 10 in Embodiment 1 will be given the same reference numerals, and description thereof will be omitted. Description for an operational effect similar to that of Embodiment 1 will be also omitted.

Figure 7:
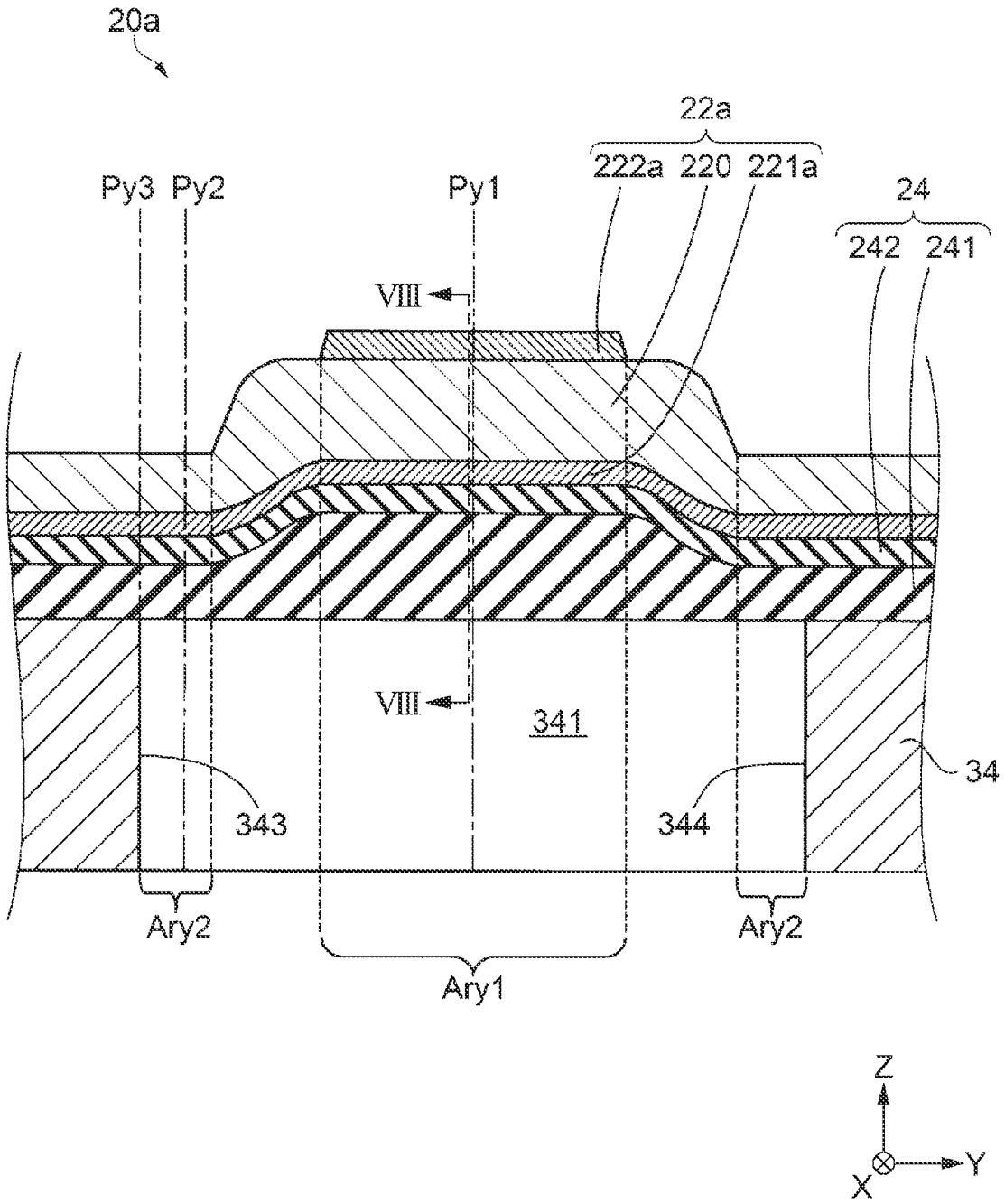
FIG. 7 is a sectional view schematically illustrating a detailed configuration of an actuator in Embodiment 2.
Figure 8:
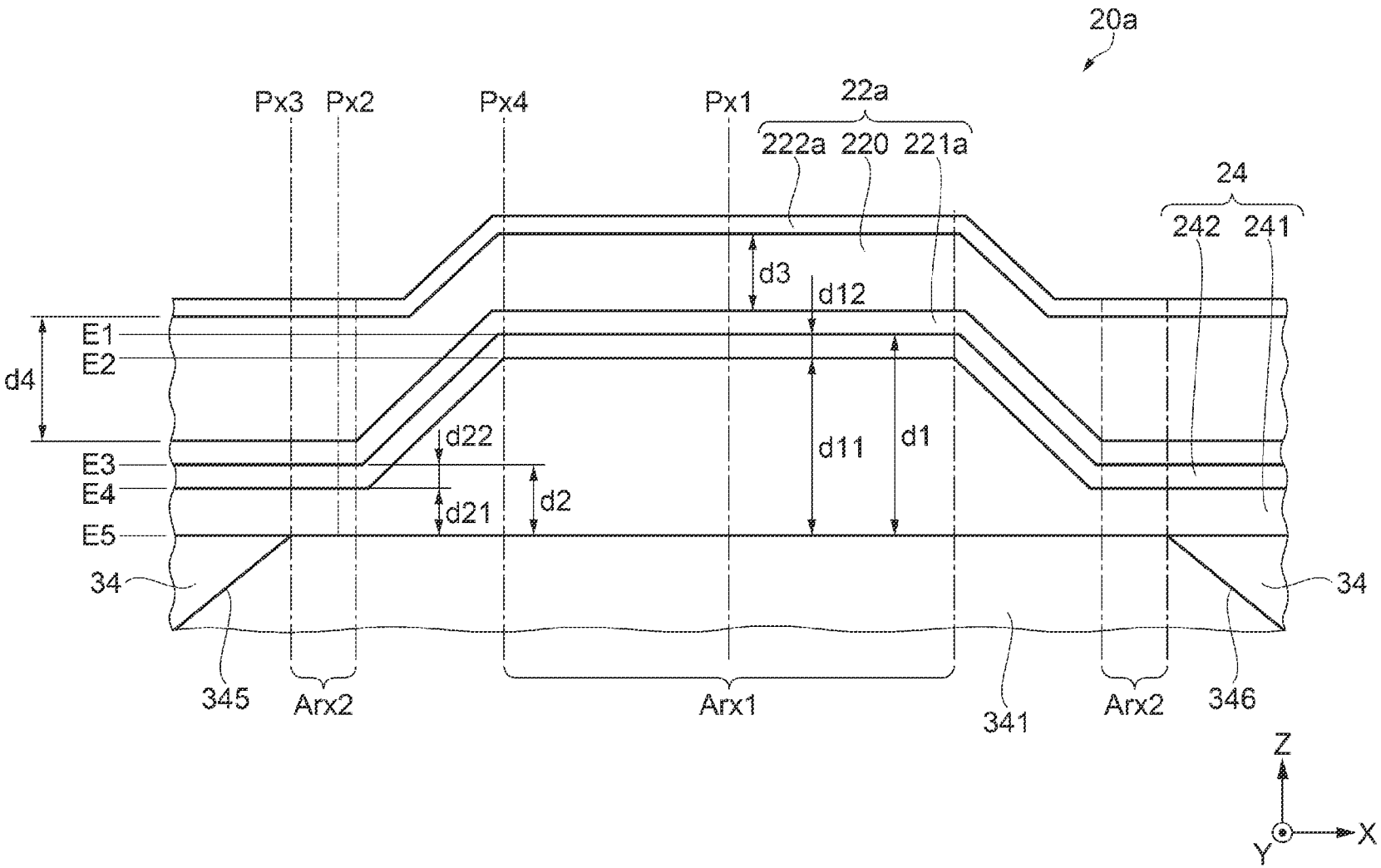
FIG. 8 is a sectional view illustrating the actuator illustrated in FIG. 7, which is taken along line VIII-VIII.

As illustrated in FIGS. 7 and 8, the actuator 20*a* of Embodiment 2 differs from the actuator 20 of Embodiment 1 in that a piezoelectric element 22*a* is provided instead of the piezoelectric element 22. The piezoelectric element 22*a* differs from the piezoelectric element 22 of Embodiment 1 in that a first electrode 221*a* is provided instead of the first electrode 221 and that a second electrode 222*a* is provided instead of the second electrode 222.

In Embodiment 1, the first electrode 221 is the individual electrode, and the second electrode 222 is the common electrode. On the other hand, in Embodiment 2, the first electrode 221*a* is a common electrode, and the second electrode 222*a* is an individual electrode. The first electrode 221*a* is coupled to the wiring substrate 90 by a common wire, and each second electrode 222*a* is coupled to the wiring substrate 90 by an individual wire. As illustrated in FIGS. 7 and 8, the first electrode 221*a* is provided on the surface of the insulation layer 242 of the vibrating plate 24 in the +Z direction and covers an outer shape of the insulation layer 242 over the entire region in the X-axis direction. In other words, the first electrode 221*a* is provided on the −Z direction side in the Z-axis direction with respect to the piezoelectric body 220. As illustrated in FIG. 7, the second electrode 222*a* is provided on the surface of the piezoelectric body 220 in the +Z direction in the first region Ary1 and is tapered such that a dimension in the X-axis direction increases from the +Z direction side toward the −Z direction side.

As described above, in the liquid ejecting head 10 according to Embodiment 2, a plurality of pressure chambers 341 are disposed in the Y-axis direction, the first electrode 221*a* is provided in common for the plurality of pressure chambers 341, the second electrode 222*a* is provided individually for the plurality of pressure chambers 341, the first electrode 221*a* is provided on the −Z direction side in the Z-axis direction with respect to the piezoelectric body 220, and the second electrode 222*a* is provided on the +Z direction side in the Z-axis direction with respect to the piezoelectric body 220. Accordingly, by separately controlling drive of the first electrode 221*a* and drive of the second electrode 222*a*, it is possible to easily achieve a configuration in which the plurality of pressure chambers 341 are separately controlled and a configuration in which the plurality of pressure chambers 341 are collectively controlled. In addition, the liquid ejecting apparatus 100 may include the liquid ejecting head 10 according to Embodiment 2 and the control unit 80 that controls an ejection operation of the liquid ejecting head 10.

Although the liquid ejecting head 10 according to Embodiment 1 or 2 of the disclosure and the liquid ejecting apparatus 100 according to Embodiment 1 or 2 basically have the above-described configuration, it is of course possible, for example, to partially change or omit a configuration without departing from the scope of the disclosure of the present application. Moreover, the embodiments described above and other embodiments described below may be implemented in combination within a range in which they do not technically contradict each other. Other embodiments will be described below.

In each of the embodiments described above, the first region Arx1 is a region in a central portion including the center in the pressure chamber 341 in the X-axis direction, and the second region Arx2 is a region in an end portion including an end in the pressure chamber 341 in the X-axis direction, but the disclosure is not limited thereto. Specifically, the first region Arx1 may be a region closer to an end of the pressure chamber 341 with respect to the center in the X-axis direction, for example, a region corresponding to a tapered portion of the piezoelectric body 220, and the second region Arx2 may be a region including a position closer than the first region Arx1 to any of the partition walls 345 and 346. That is, the configuration may be typically such that the first region Arx1 is any region in the pressure chamber 341 in the X-axis direction and that the second region Arx2 is a region outside the first region Arx1 in the X-axis direction.

In each of the embodiments described above, the first position Px1 is a position of the center of the pressure chamber 341 in the X-axis direction, but is not limited to the position of the center and may be any position of the pressure chamber 341 in the X-axis direction. In this instance, the second position Px2 may be any another position as long as the position is closer than the first position Px1 to any of the partition walls 345 and 346 in the pressure chamber 341.

In each of the embodiments described above, the bending rigidity in the fourth region Ary2 including the fourth position Py2 and position Py3 is not necessarily smaller than the bending rigidity in the third region Ary1 including the third position Py1 and may be substantially the same as the bending rigidity in the third region Ary1 as long as the bending rigidity FR2 satisfies the aforementioned formula, $0.35\times FR1 \leq FR2 < 1.00\times FR1$. Note that the bending rigidity here indicates the bending rigidity of the actuator 20 in the Z-axis direction. For example, $0.9\times FR3 \leq FR4 < 1.1\times FR3$ may be satisfied, where one position in the Y-axis direction of the pressure chamber 341 is the third position Py1, another position closer than the third position Py1 to an end of the pressure chamber 341 in the Y-axis direction of the pressure chamber 341 is the fourth position Py2, the bending rigidity of the actuator 20 at the third position Py1 is FR3, and the bending rigidity of the actuator 20 at the fourth position Py2 is FR4. In this instance, for example, a convex portion of the piezoelectric body 220, which protrudes in the +Z direction, may have a shape extending from a position in the −Y direction with respect to the end of the partition wall 343 in the +Z direction up to a position in the +Y direction with respect to the end of the partition wall 344 in the +Z direction.

In each of the embodiments described above, the convex portion of the piezoelectric body 220, which protrudes in the +Z direction, may have a shape extending from a position in the −X direction with respect to the end of the partition wall 345 in the +Z direction up to a position in the +X direction with respect to the end of the partition wall 346 in the +Z direction as long as the bending rigidity FR2 satisfies the aforementioned formula, $0.35\times FR1 \leq FR2 < 1.00\times FR1$. In this instance, for example, a maximum width of the convex portion in the Y-axis direction at the second position Px2 may be narrower than a maximum width of the convex portion in the Y-axis direction at the first position Px1.

In each of the embodiments described above, the vibrating plate 24 does not necessarily have a convex shape protruding in the +Z direction as long as the bending rigidity FR2 satisfies the aforementioned formula, $0.35\times FR1 \leq FR2 < 1.00\times FR1$. For example, the vibrating plate 24 may include a convex portion in which the −Z direction surface in the third region Ary1 protrudes in the −Z direction further than the −Z direction surface in the fourth region Ary2 and in which the −Z direction surface in the first region Arx1 protrudes in the −Z direction further than the −Z direction surface in the second region Arx2. In this instance, the convex portion of the vibrating plate 24 may protrude into the pressure chamber 341.

In each of the embodiments described above, the piezoelectric body 220 does not necessarily have a convex shape protruding in the +Z direction as long as the bending rigidity FR2 satisfies the aforementioned formula, $0.35\times FR1\leq FR2<1.00\times FR1$. In this instance, for example, the piezoelectric body 220 may have a flat surface in which the +Z direction surface does not have a convex shape.

In each of the embodiments described above, thickness d4 of the piezoelectric body 220 in the second region Arx2 may be smaller than thickness d3 of the piezoelectric body 220 in the first region Arx1 as long as the bending rigidity FR2 satisfies the aforementioned formula, $0.35\times FR1\leq FR2<1.00\times FR1$.

In each of the embodiments described above, a sum of thickness d2 of the vibrating plate 24 and thickness d4 of the piezoelectric body 220 in the second region Arx2 is not necessarily smaller than a sum of thickness d1 of the vibrating plate 24 and thickness d3 of the piezoelectric body 220 in the first region Arx1 as long as the bending rigidity FR2 satisfies the aforementioned formula, $0.35\times FR1\leq FR2<1.00\times FR1$.

In each of the embodiments described above, a difference between thickness d2 of the vibrating plate 24 and thickness d4 of the piezoelectric body 220 in the second region Arx2 is not necessarily larger than a difference between thickness d1 of the vibrating plate 24 and thickness d3 of the piezoelectric body 220 in the first region Arx1 as long as the bending rigidity FR2 satisfies the aforementioned formula, $0.35\times FR1\leq FR2<1.00\times FR1$.

In each of the embodiments described above, a sum of thickness d2 of the vibrating plate 24 and thickness d4 of the piezoelectric body 220 in the second region Arx2 may have a value which is less than or equal to thickness d1 of the vibrating plate 24 in the first region Arx1 or a value which is less than or equal to thickness d3 of the piezoelectric body 220 as long as the bending rigidity FR2 satisfies the aforementioned formula, $0.35\times FR1\leq FR2<1.00\times FR1$.

In each of the embodiments described above, thickness d4 of the piezoelectric body 220 in the second region Arx2 may be larger than thickness d1 of the vibrating plate 24 in the first region Arx1 as long as the bending rigidity FR2 satisfies the aforementioned formula, $0.35\times FR1\leq FR2<1.00\times FR1$.

In each of the embodiments described above, thickness d22 of the insulation layer 242 in the second region Arx2 is not necessarily equal to thickness d12 of the insulation layer 242 in the first region Arx1 as long as the bending rigidity FR2 satisfies the aforementioned formula, $0.35\times FR1\leq FR2<1.00\times FR1$. In addition, thickness d21 of the elastic body layer 241 in the second region Arx2 is not necessarily smaller than thickness d11 of the elastic body layer 241 in the first region Arx1.

In each of the embodiments described above, the thickness of the vibrating plate 24 at position Px3 is not necessarily smaller than thickness d1 of the vibrating plate 24 in the first region Arx1 as long as the bending rigidity FR2 satisfies the aforementioned formula, $0.35\times FR1\leq FR2<1.00\times FR1$.

In each of the embodiments described above, the communication channel 326 may communicate with the nozzle N and the +X direction end portion of the pressure chamber 341. In this instance, the pressure chamber 341 may be provided such that the +X direction end portion of the pressure chamber 341 communicates with the nozzle N and the −X direction end portion of the pressure chamber 341 communicates with the supply channel 324.

In each of the embodiments described above, the elastic body layer 241 is formed of silicon dioxide, and the insulation layer 242 is formed of zirconium oxide, but both the elastic body layer 241 and the insulation layer 242 may be formed of silicon dioxide or zirconium oxide. Moreover, the elastic body layer 241 may be formed of another elastic material, such as silicon. The insulation layer 242 may be formed of another insulation material, such as zirconium, titanium, or silicon nitride.

In each of the embodiments described above, liquid other than ink may be ejected from the nozzles N.

What is claimed is:

1. A liquid ejecting head comprising:

an actuator that includes a piezoelectric element which includes a first electrode, a second electrode, and a piezoelectric body and in which the piezoelectric body is provided between the first electrode and the second electrode in a thickness direction in which the first electrode, the second electrode, and the piezoelectric body are stacked and a vibrating plate which is provided on one side in the thickness direction with respect to the piezoelectric element; and a pressure chamber substrate that is provided on the one side in the thickness direction with respect to the vibrating plate and that includes a pressure chamber whose volume changes when the vibrating plate deforms, wherein when defining one direction of the pressure chamber that intersects that thickness direction is a longitudinal direction, and another direction of the pressure chamber that intersects the thickness direction and the longitudinal direction and is shorter than the longitudinal direction is a transverse direction, one position in the longitudinal direction of the pressure chamber is a first position, another position closer than the first position to an end of the pressure chamber in the longitudinal direction of the pressure chamber is a second position, bending rigidity of the actuator in the thickness direction at the first position is FR1, and bending rigidity of the actuator in the thickness direction at the second position is FR2 and $$0.35\times FR1\leq FR2<1.00\times FR1.$$

2. The liquid ejecting head according to claim 1, wherein $$FR2<0.85\times FR1.$$

3. The liquid ejecting head according to claim 1, wherein a thickness of the vibrating plate at the second position is smaller than a thickness of the vibrating plate at the first position.

4. The liquid ejecting head according to claim 1, wherein a thickness of the piezoelectric body at the second position is larger than a thickness of the piezoelectric body at the first position.

5. The liquid ejecting head according to claim 1, wherein a sum of a thickness of the vibrating plate at the second position and a thickness of the piezoelectric body at the second position is smaller than a sum of a thickness of the vibrating plate at the first position and a thickness of the piezoelectric body at the first position.

6. The liquid ejecting head according to claim 1, wherein $$0.9\times FR3\leq FR4<1.1\times FR3, \text{ wherein}$$

one position in the transverse direction of the pressure chamber is a third position, another position closer than the third position to an end of the pressure chamber in the transverse direction of the pressure chamber is a fourth position, bending rigidity of the actuator in the thickness direction at the third position is FR3, and bending rigidity of the actuator in the thickness direction at the fourth position is FR4.

7. The liquid ejecting head according to claim 1, wherein when a region including a center in the longitudinal direction of the pressure chamber is a central portion, and a region including the end in the longitudinal direction of the pressure chamber is an end portion, the first position is included in the central portion, and the second position is included in the end portion.

8. The liquid ejecting head according to claim 1, wherein a plurality of pressure chambers, each of which is the pressure chamber whose volume changes when the vibrating plate deforms, are disposed in the transverse direction, the first electrode is provided individually for the plurality of pressure chambers, the second electrode is provided in common for the plurality of pressure chambers, the first electrode is provided on the one side in the thickness direction with respect to the piezoelectric body, and the second electrode is provided on another side in the thickness direction with respect to the piezoelectric body.

9. The liquid ejecting head according to claim 1, wherein a plurality of pressure chambers, each of which is the pressure chamber whose volume changes when the vibrating plate deforms, are disposed in the transverse direction, the first electrode is provided in common for the plurality of pressure chambers, the second electrode is provided individually for the plurality of pressure chambers, the first electrode is provided on the one side in the thickness direction with respect to the piezoelectric body, and the second electrode is provided on another side in the thickness direction with respect to the piezoelectric body.

10. The liquid ejecting head according to claim 1, wherein the pressure chamber is provided such that one end side in the longitudinal direction of the pressure chamber communicates with a nozzle for ejecting a liquid and another end side in the longitudinal direction of the pressure chamber communicates with a supply channel for supplying the liquid to the pressure chamber.

11. A liquid ejecting apparatus comprising:

the liquid ejecting head according to claim 1; and a control section that controls an ejection operation of the liquid ejecting head.

* * * * *